US009872535B2

(12) United States Patent
Beye et al.

(10) Patent No.: US 9,872,535 B2
(45) Date of Patent: Jan. 23, 2018

(54) ARTICLE OF FOOTWEAR WITH A HARNESS AND FLUID-FILLED CHAMBER ARRANGEMENT

(71) Applicant: Nike, Inc., Beaverton, OR (US)

(72) Inventors: Douglas A. Beye, Beaverton, OR (US); Benjamin J. Monfils, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 741 days.

(21) Appl. No.: 13/723,116

(22) Filed: Dec. 20, 2012

(65) Prior Publication Data

US 2014/0173938 A1 Jun. 26, 2014

(51) Int. Cl.

| | |
|---|---|
| ***A43B 9/12*** | (2006.01) |
| ***A43B 13/12*** | (2006.01) |
| ***A43B 13/20*** | (2006.01) |
| ***A43B 23/08*** | (2006.01) |
| ***A43B 23/02*** | (2006.01) |

(52) U.S. Cl.

CPC ..... *A43B 9/12* (2013.01); *A43B 13/125* (2013.01); *A43B 13/20* (2013.01); *A43B 23/026* (2013.01); *A43B 23/0265* (2013.01); *A43B 23/086* (2013.01)

(58) Field of Classification Search

CPC ..... A43B 13/25; A43B 13/20; A43B 13/181; A43B 13/18; A43B 13/186; A43B 13/187; A43B 13/189; A43B 13/0235; A43B 23/0245; A43B 23/026; A43B 23/22; A43B 23/227; A43B 7/20; A43B 23/0235; A43B 9/12; A43B 7/1415; A43B 7/1455; A43B 7/32; A43B 23/086; A43C 1/006

USPC ..... 36/102, 28, 30 R, 30 A, 35 R, 37, 50.1

See application file for complete search history.

(56) References Cited

U.S. PATENT DOCUMENTS

| | | | | |
|---|---|---|---|---|
| 1,090,106 A | | 3/1914 | Montine | |
| 2,808,664 A | | 10/1957 | Frieder et al. | |
| 4,361,969 A | | 12/1982 | Vermonet | |
| 4,447,967 A | * | 5/1984 | Zaino | A43B 23/0235 36/45 |
| 4,506,460 A | | 3/1985 | Rudy | |
| 4,989,350 A | * | 2/1991 | Bunch | A43B 5/00 36/114 |
| 5,155,927 A | * | 10/1992 | Bates | A43B 13/189 36/114 |

(Continued)

*Primary Examiner* — Jameson Collier
*Assistant Examiner* — Heather Mangine
(74) *Attorney, Agent, or Firm* — Honigman Miller Schwartz and Cohn LLP; Matthew H. Szalach; Jonathan P. O'Brien

(57) ABSTRACT

An article of footwear is disclosed having a structural harness and impact-attenuating structure arrangement that includes a fluid-filled chamber. The article includes an upper, a sole secured to the upper having an impact-attenuating structure including a fluid-filled chamber and a structural harness. The structural harness may extend between the upper and fluid-filled chamber in a tensile arrangement that biases the fluid-filled chamber toward the upper and compresses the chamber. The structural harness may include a first layer, a thread layer bonded to the first layer and a second layer bonded to the thread layer on an opposite side of the thread layer. The thread layer may include threads configured to transmit tensile forces and restrict stretch in a longitudinal direction of the threads.

21 Claims, 11 Drawing Sheets

(56) References Cited

U.S. PATENT DOCUMENTS 5,317,820 A * 6/1994 Bell ..... A43B 5/00 36/114
5,533,279 A * 7/1996 Mitsui ..... A43B 5/00 36/45
5,741,568 A * 4/1998 Rudy ..... A43B 7/141 36/28
5,753,061 A * 5/1998 Rudy ..... A41D 31/0044 156/145
5,755,001 A * 5/1998 Potter ..... A43B 13/20 12/142 P
5,806,208 A 9/1998 French
5,930,918 A * 8/1999 Healy ..... A43B 13/18 36/29
6,029,376 A * 2/2000 Cass ..... A43C 1/04 36/50.1
6,272,772 B1 * 8/2001 Sherman ..... A43B 5/16 36/89
6,298,582 B1 * 10/2001 Friton ..... A43B 5/06 36/102
6,796,056 B2 * 9/2004 Swigart ..... A43B 7/144 36/141
6,837,951 B2 1/2005 Rapaport
6,944,973 B2 * 9/2005 Goodwin ..... A43B 13/12 36/29
7,086,180 B2 * 8/2006 Dojan ..... A43B 13/20 36/29
7,132,032 B2 * 11/2006 Tawney ..... A43B 13/20 12/142 P
7,337,560 B2 * 3/2008 Marvin ..... A43B 13/20 36/29
7,487,604 B2 2/2009 Perron, Jr.
7,546,698 B2 6/2009 Meschter
7,574,818 B2 * 8/2009 Meschter ..... A43B 7/14 36/45
7,870,681 B2 * 1/2011 Meschter ..... A43B 3/26 36/45
8,215,033 B2 7/2012 Carboy et al.
8,578,632 B2 * 11/2013 Bell ..... A43B 1/0072 36/45
9,060,567 B2 * 6/2015 Elder ..... A43B 13/127
2003/0046831 A1 * 3/2003 Westin ..... A43B 13/187 36/29
2003/0056400 A1 * 3/2003 Potter ..... A43B 13/143 36/88
2003/0188455 A1 * 10/2003 Weaver, III ..... A43B 3/0063 36/27
2004/0181972 A1 * 9/2004 Csorba ..... A43B 7/1495 36/50.1
2005/0274045 A1 * 12/2005 Seiner ..... A41B 11/003 36/89
2006/0048413 A1 * 3/2006 Sokolowski ..... A43B 23/0235 36/45
2006/0117600 A1 * 6/2006 Greene ..... A43B 13/141 36/9 R
2007/0107264 A1 * 5/2007 Meschter ..... A43B 5/12 36/76 R
2007/0119075 A1 * 5/2007 Schindler ..... A43B 7/144 36/29
2007/0141282 A1 * 6/2007 Chang ..... A43B 13/20 428/35.2
2007/0271823 A1 * 11/2007 Meschter ..... A43B 9/02 36/45
2008/0110048 A1 * 5/2008 Dua ..... A43B 1/04 36/45
2008/0110049 A1 * 5/2008 Sokolowski ..... A43B 3/0031 36/50.1
2008/0184595 A1 * 8/2008 Schindler ..... A43B 1/0027 36/29
2008/0229614 A1 * 9/2008 Santa Ana ..... A43B 1/0054 36/100
2009/0071041 A1 * 3/2009 Hooper ..... A43B 7/06 36/3 A
2009/0100710 A1 4/2009 Potter et al.
2009/0183387 A1 * 7/2009 Ellis ..... A41D 19/01523 36/29
2009/0260259 A1 10/2009 Berend
2009/0288312 A1 * 11/2009 Dua ..... A43B 1/04 36/29
2009/0293309 A1 * 12/2009 Keating ..... A43B 5/10 36/88
2010/0037483 A1 * 2/2010 Meschter ..... A43B 3/26 36/47
2010/0083535 A1 * 4/2010 Meschter ..... A43B 7/1495 36/88
2010/0107442 A1 * 5/2010 Hope ..... A43B 23/024 36/50.1
2010/0154256 A1 * 6/2010 Dua ..... A43B 1/04 36/25 R
2010/0175276 A1 * 7/2010 Dojan ..... A43B 3/26 36/47
2010/0251491 A1 * 10/2010 Dojan ..... A43B 23/0225 12/142 R
2010/0263236 A1 * 10/2010 Carboy ..... A43B 1/0072 36/117.1
2011/0113648 A1 * 5/2011 Leick ..... A43B 1/0081 36/50.1
2011/0113650 A1 * 5/2011 Hurd ..... A43B 23/08 36/107
2011/0131831 A1 * 6/2011 Peyton ..... A43B 13/20 36/29
2011/0162239 A1 * 7/2011 Bier ..... A43B 1/04 36/3 B
2011/0192059 A1 * 8/2011 Spanks ..... A43B 1/0072 36/137
2011/0271552 A1 * 11/2011 Peyton ..... A43B 13/20 36/29
2011/0277347 A1 * 11/2011 Monfils ..... A43B 13/189 36/29
2011/0308108 A1 * 12/2011 Berns ..... A43B 5/02 36/50.1
2012/0199277 A1 * 8/2012 Loveder ..... A43B 1/0027 156/242
2012/0255201 A1 * 10/2012 Little ..... A43B 1/04 36/84
2013/0160329 A1 * 6/2013 Peyton ..... A43B 5/06 36/105
2016/0128424 A1 * 5/2016 Connell ..... A43B 23/0265 36/103

* cited by examiner

ARTICLE OF FOOTWEAR WITH A HARNESS AND FLUID-FILLED CHAMBER ARRANGEMENT

BACKGROUND

Conventional articles of athletic footwear may include two primary elements: an upper and a sole structure. The upper may be generally formed from a plurality of elements (e.g., textiles, foam, leather, synthetic leather) that are stitched or adhesively bonded together to form an interior void for securely and comfortably receiving a foot. The sole structure may incorporate multiple layers that are conventionally referred to as a sockliner, a midsole, and an outsole. The sockliner may be a thin, compressible member located within the void of the upper and adjacent to a plantar (i.e., lower) surface of the foot to enhance comfort. The midsole may be secured to the upper and form a middle layer of the sole structure that attenuates ground reaction forces during walking, running, or other ambulatory activities. The outsole may form a ground-contacting element of the footwear and usually may be fashioned from a durable and wear-resistant rubber material that includes texturing to impart traction.

The primary material forming many conventional midsoles may be a polymer foam, such as polyurethane or ethylvinylacetate. In some articles of footwear, the midsole may also incorporate a sealed and fluid-filled chamber that increases durability of the footwear and enhances ground reaction force attenuation of the sole structure. The fluid-filled chamber may be at least partially encapsulated within the polymer foam, as disclosed in U.S. Pat. No. 5,755,001 to Potter, et al., U.S. Pat. No. 6,837,951 to Rapaport, and U.S. Pat. No. 7,132,032 to Tawney, et al., each of which is herein incorporated by reference. In other footwear configurations, the fluid-filled chamber may substantially replace the polymer foam, as disclosed in in U.S. Pat. No. 7,086,180 to Dojan, et al., also herein incorporated by reference. In general, the fluid-filled chambers may be formed from an elastomeric polymer material that is sealed and pressurized, but may also be substantially unpressurized. In some configurations, textile or foam tensile members may be located within the chamber or reinforcing structures and may be bonded to an exterior surface of the chamber to impart shape to or retain an intended shape of the chamber.

Articles of footwear having an upper or other component with structural elements formed of threads have also been previously proposed. U.S. Pat. Nos. 7,574,818 and 7,546,698 to Meschter, each of which is herein incorporated by reference, disclose articles of footwear having an upper with thread structural elements. The thread sections may be positioned to provide structural elements that restrict stretch in directions corresponding with longitudinal axes of the thread sections.

SUMMARY

An article of footwear comprising a structural harness and fluid-filled chamber arrangement may provide various advantageous features, such as increased stability, shock absorption, and compression control features. Consistent with an embodiment, an article of footwear is provided, comprising an upper; a sole structure comprising a lateral side portion, an opposite medial side portion, a top portion proximate the upper, and an opposite bottom portion, the sole structure being secured to the upper and including an impact-attenuating structure comprising at least one fluid-filled chamber; and a structural harness extending between the upper and the impact-attenuating structure in a tensile arrangement, the structural harness biasing the impact-attenuating structure toward the upper.

Consistent with an embodiment, the structural harness may include a first base layer and a thread layer bonded to the first base layer. For example, a second base layer may be bonded to the thread layer on an opposite side of the thread layer from the first base layer. The thread layer may include a plurality of threads configured to transmit tensile forces longitudinally and restrict stretch in a longitudinal direction of the threads. The structural harness may be bonded to various portions of the fluid-filled chamber, such as side portions and/or bottom portions of the chamber.

Also consistent with an embodiment, an article of footwear is provided, comprising, an upper; a sole structure secured to the upper; and an expansion-limited gas spring, comprising: at least one gas-filled chamber integrated with the sole structure; and an expansion-limiter disposed outside of the at least one gas-filled chamber and attached to the upper and the at least one gas-filled chamber, the expansion-limiter configured to mechanically limit expansion of the at least one gas-filled chamber in a downward direction away from the upper.

Moreover, consistent with an embodiment, an article of footwear is provided, comprising: an upper; a sole structure comprising a lateral side portion, an opposite medial side portion, a top portion proximate the upper, and an opposite bottom portion, the sole structure being secured to the upper; a compressible and expandable fluid-filled chamber integrated in a portion of the sole structure; and a structural harness attached to the upper, extending downward from the upper to the fluid-filled chamber, and being bonded to an outer portion of the fluid-filled chamber, the structural harness comprising: a first textile layer; a second textile layer generally parallel to and opposing the first textile layer; and a plurality of structural threads disposed between the first and second textile layers and bonded to the first and second textile layers, each of the plurality of structural threads transmitting tensile forces longitudinally and restricting stretch in a longitudinal direction of the thread, wherein portions of the structural threads extending downward from the upper to the outer portion of the fluid-filled chamber are in a generally tensile configuration and transmit forces to bias the fluid-filled chamber in an upward direction toward a top region of the sole structure proximate the upper.

The disclosed article of footwear may also include various types of footwear including closed shoes, such as athletic shoes, or open shoes, such as sandals. The structural harness may be bonded to one or more subsections of the upper in some arrangements, and may be bonded to extend over substantial regions of the upper in other arrangements including being substantially integrated with the upper to extend about the majority of the upper and may structurally interface with the lace eyelet region of the upper. In further configurations, such as sandals and other open shoe configurations, the structural harness may be bonded to and/or integrally formed with retention straps of the upper including an open strap configured to cover a midfoot region of the foot or other regions like heel and/or forefoot regions.

Advantages and features of novelty characterizing aspects of the disclosure are pointed out with particularity in the appended claims. To gain an improved understanding of advantages and features of novelty, however, reference may be made to the present disclosure and accompanying figures that describe and illustrate various embodiments.

FIGURE DESCRIPTIONS

The accompanying drawings, which are incorporated in and constitute a part of this specification, illustrate embodiments and, together with the description, serve to explain the features, advantages, and principles of the embodiments disclosed throughout this disclosure. For illustration purposes, the following drawings may not be to scale. Moreover, like reference numerals designate corresponding parts throughout the different views. In the drawings.

Figure 1:
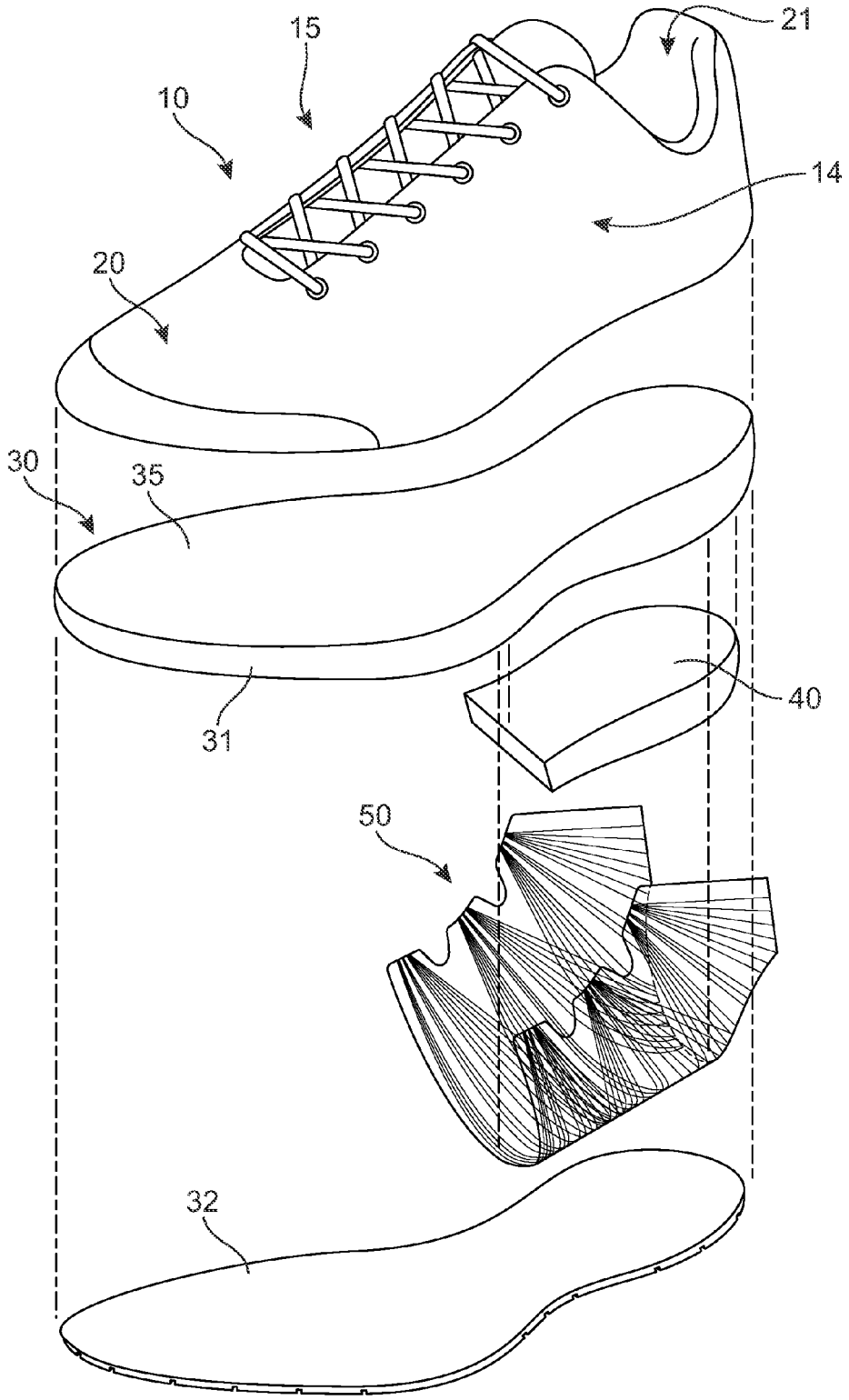
FIG. 1 is an exploded perspective view of an article of footwear having a fluid-filled chamber in an arrangement with a harness having structural threads connected to the upper and fluid-filled chamber.
Figure 3:
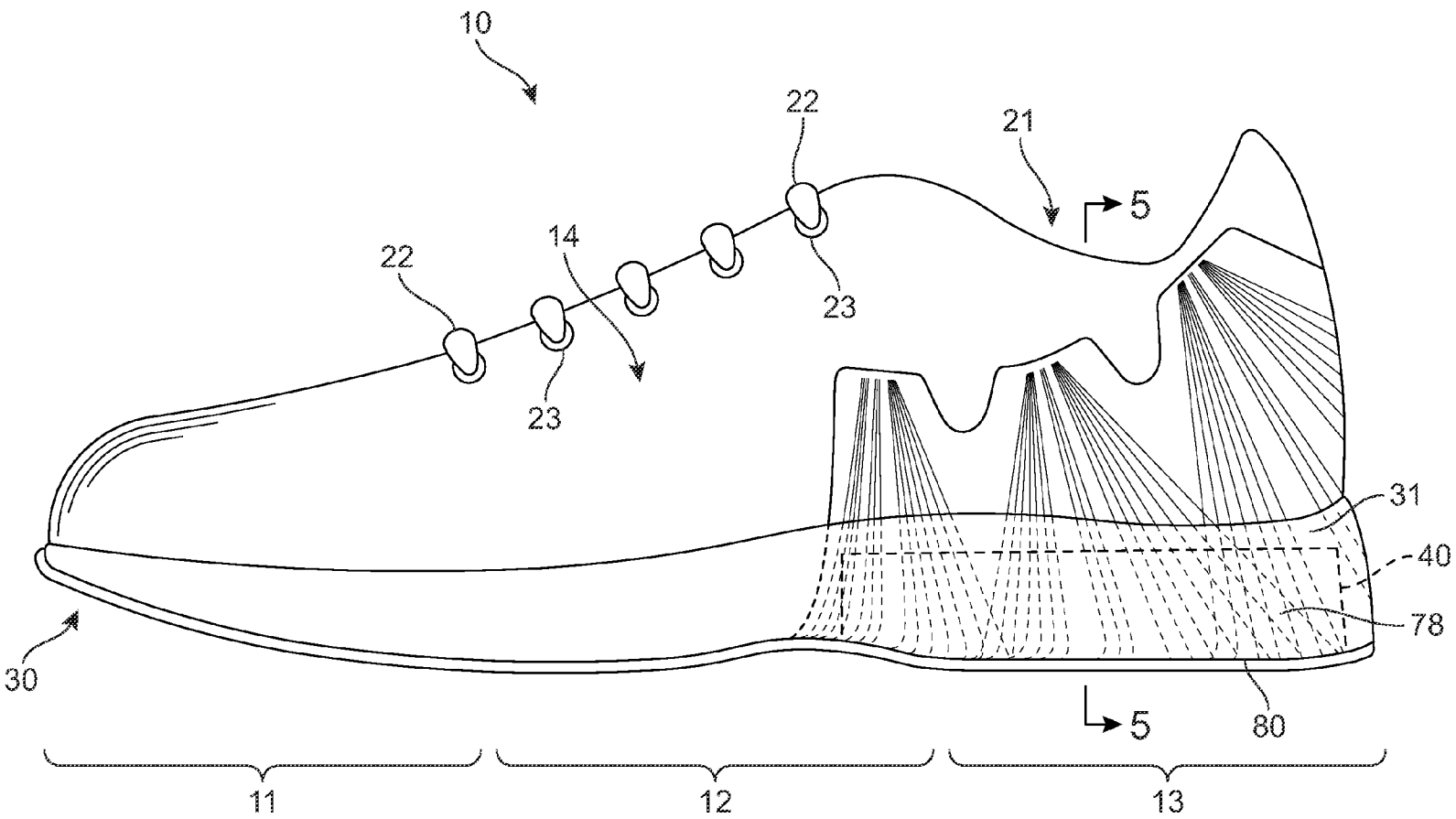
FIG. 3 is a lateral side view of the article of footwear of FIG. 1.
Figure 4:
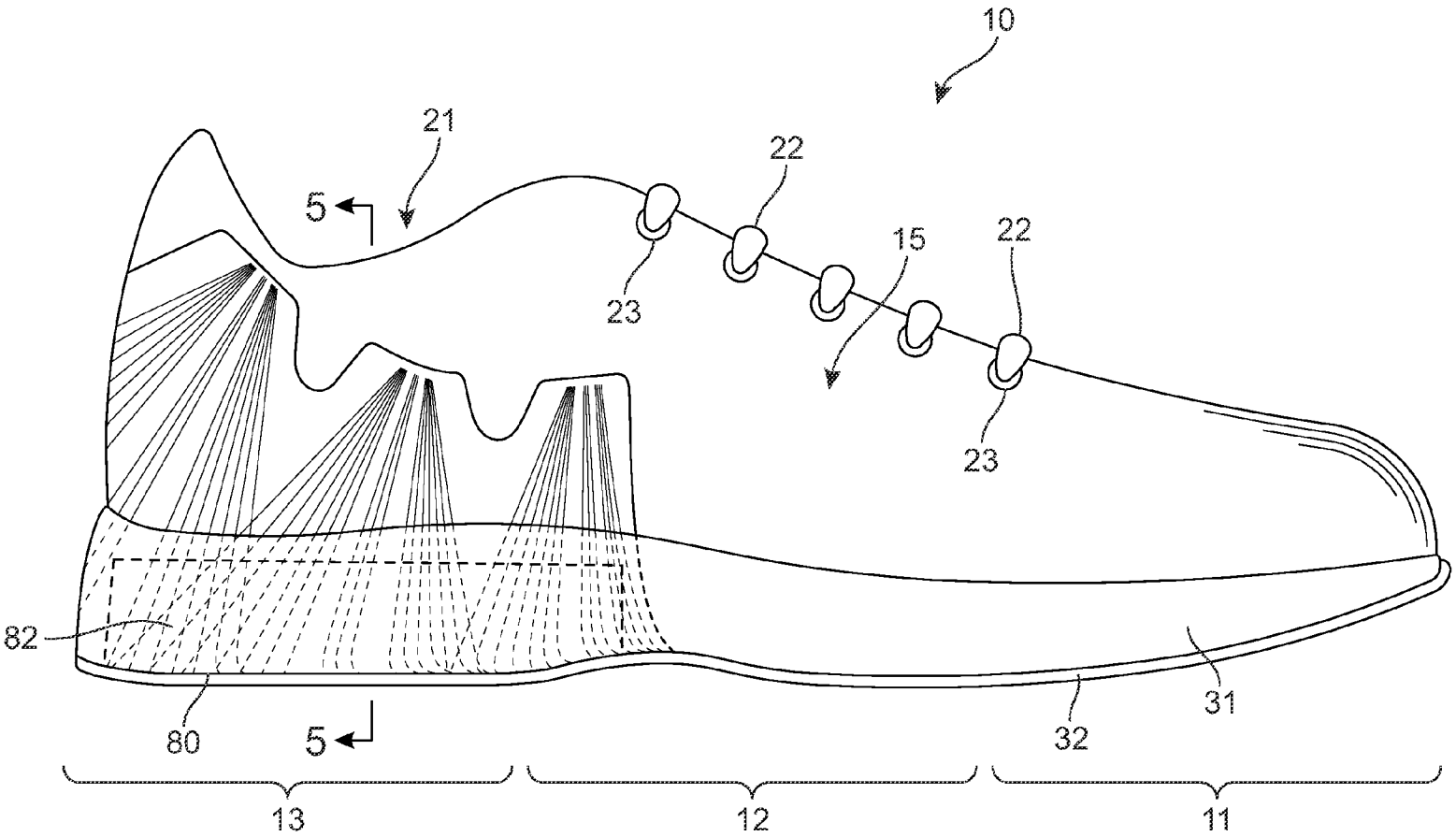
FIG. 4 is a medial side view of the article of footwear of FIG. 1.
Figure 5:
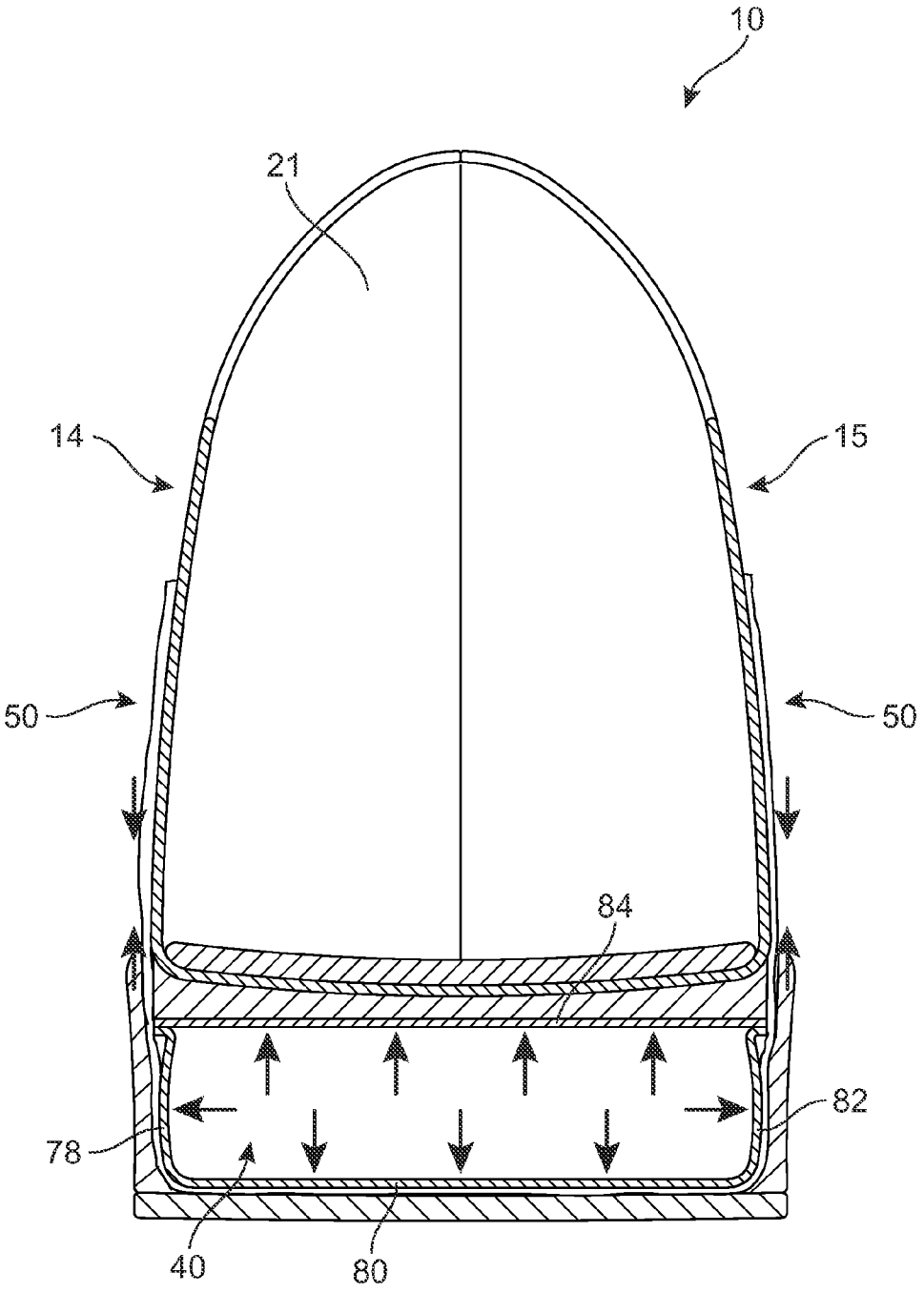
Figure 6:
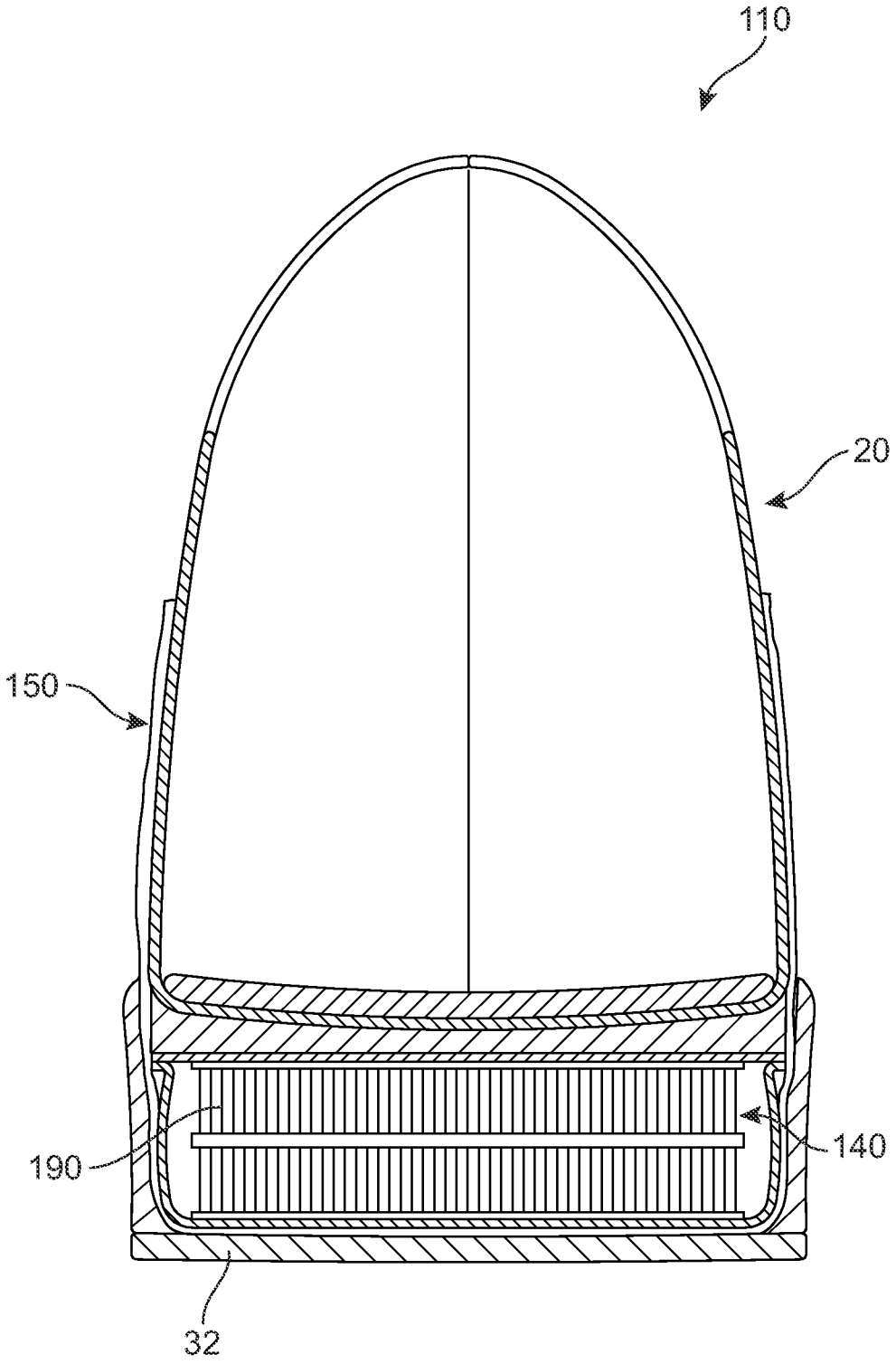
Figure 7:
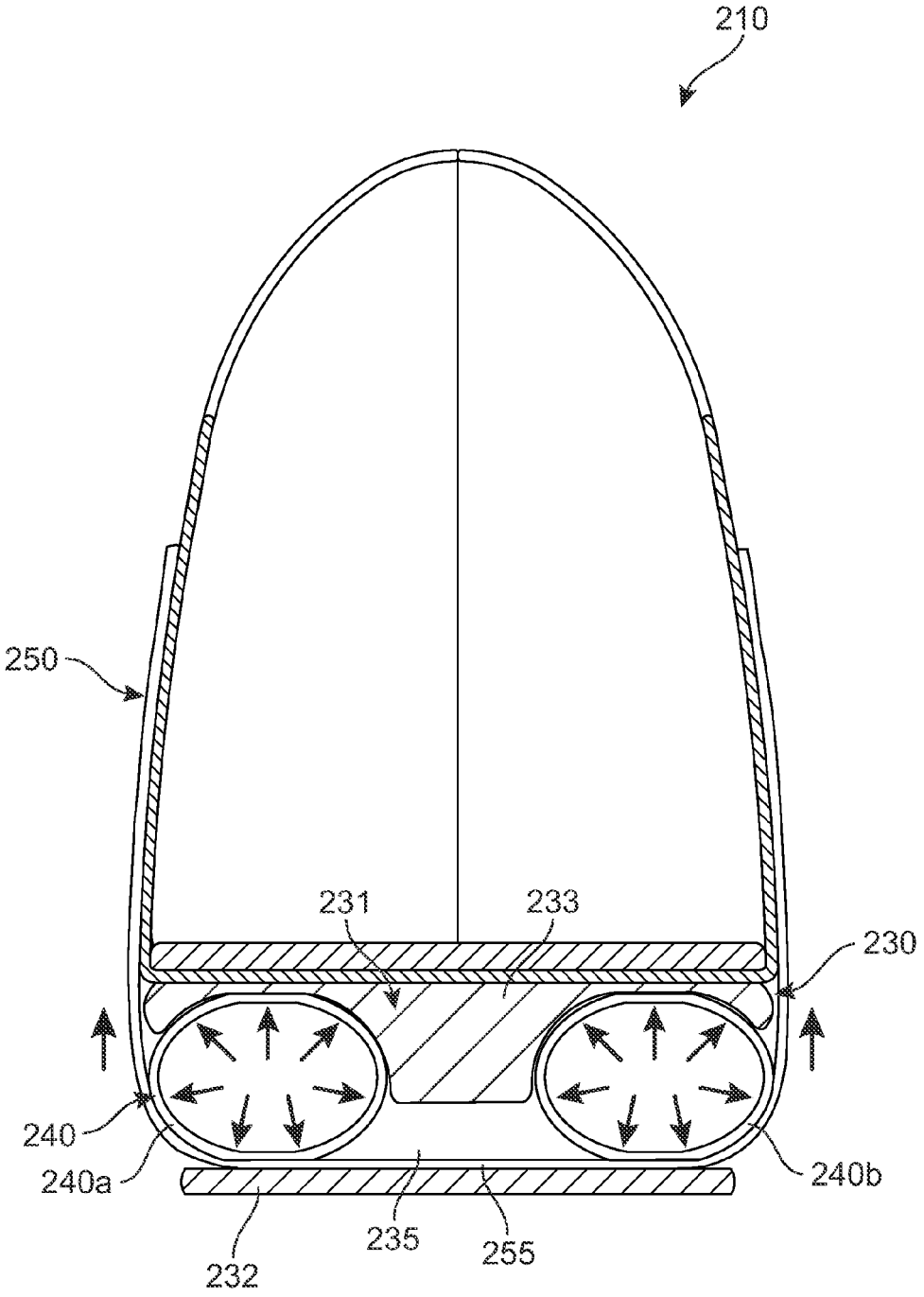
Figure 8:
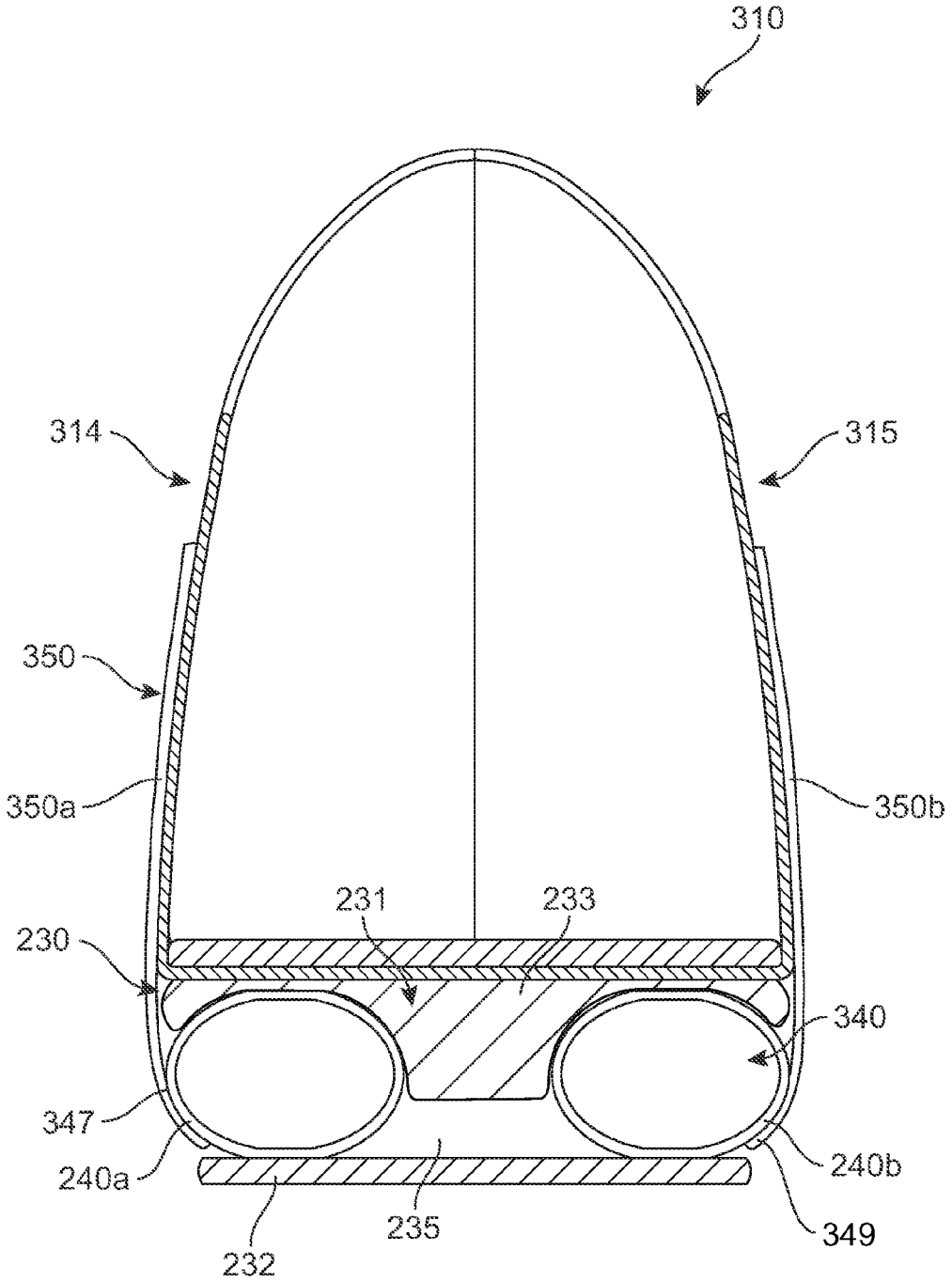
Figure 9:
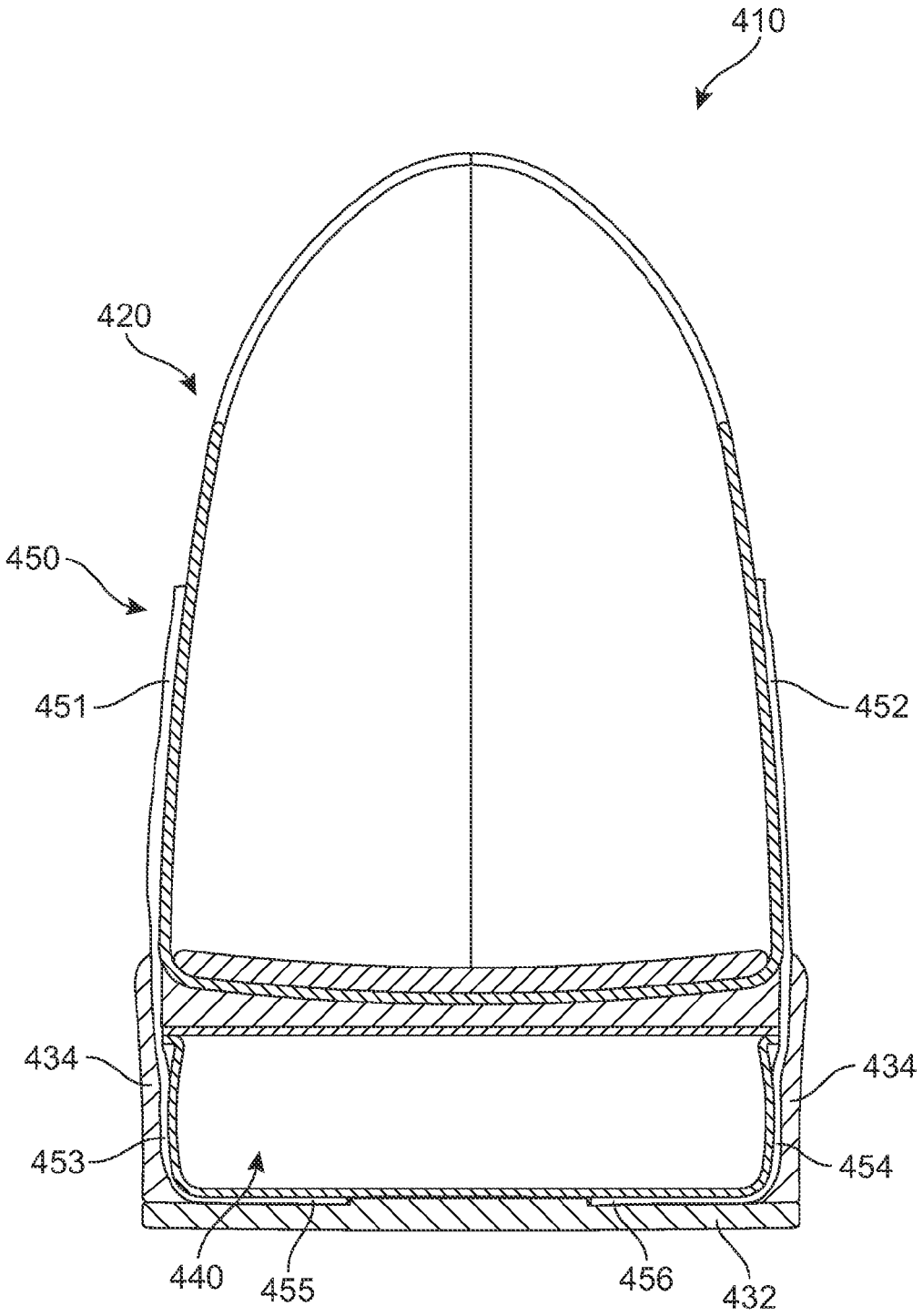
Figure 10:
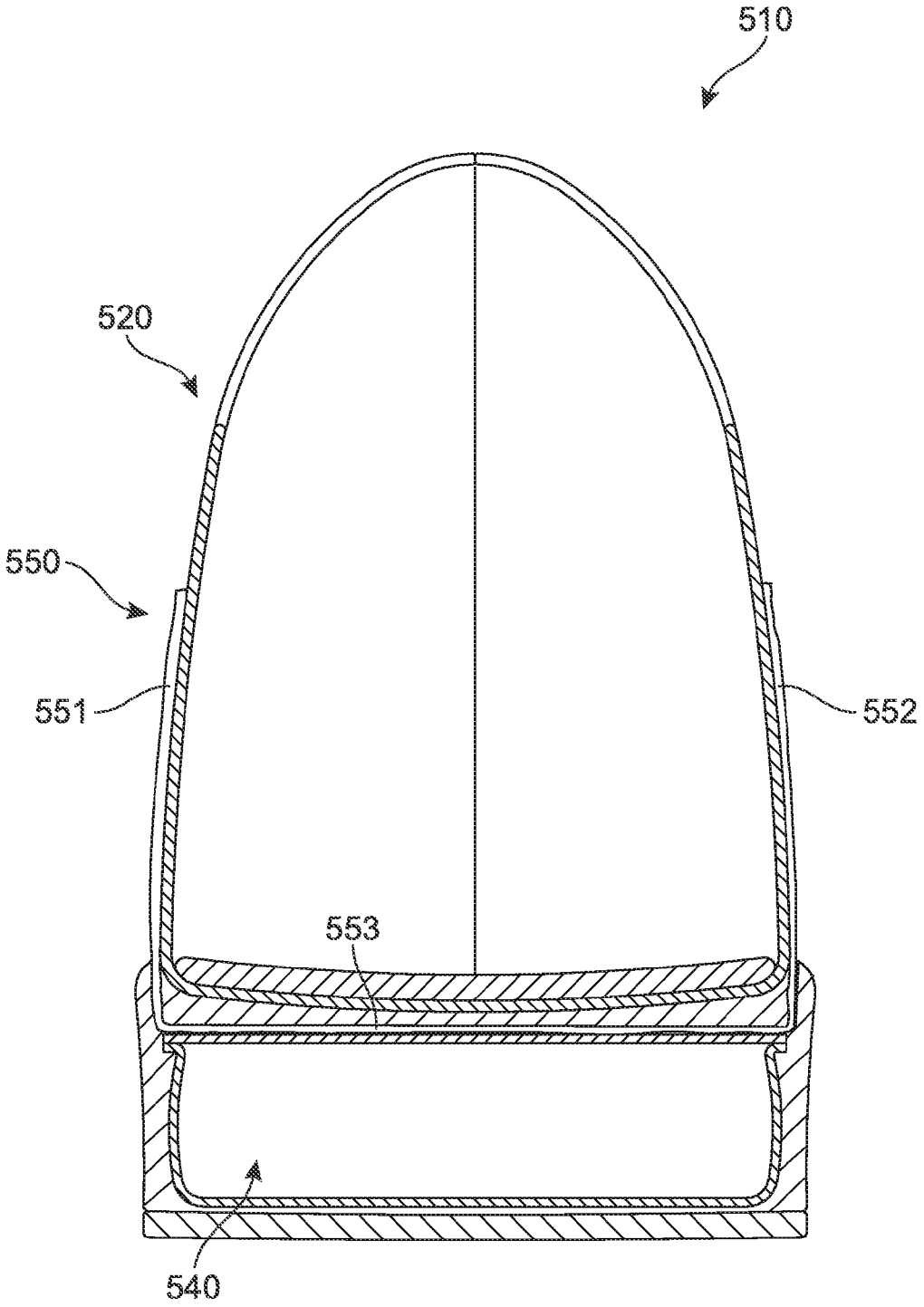
Figure 11:
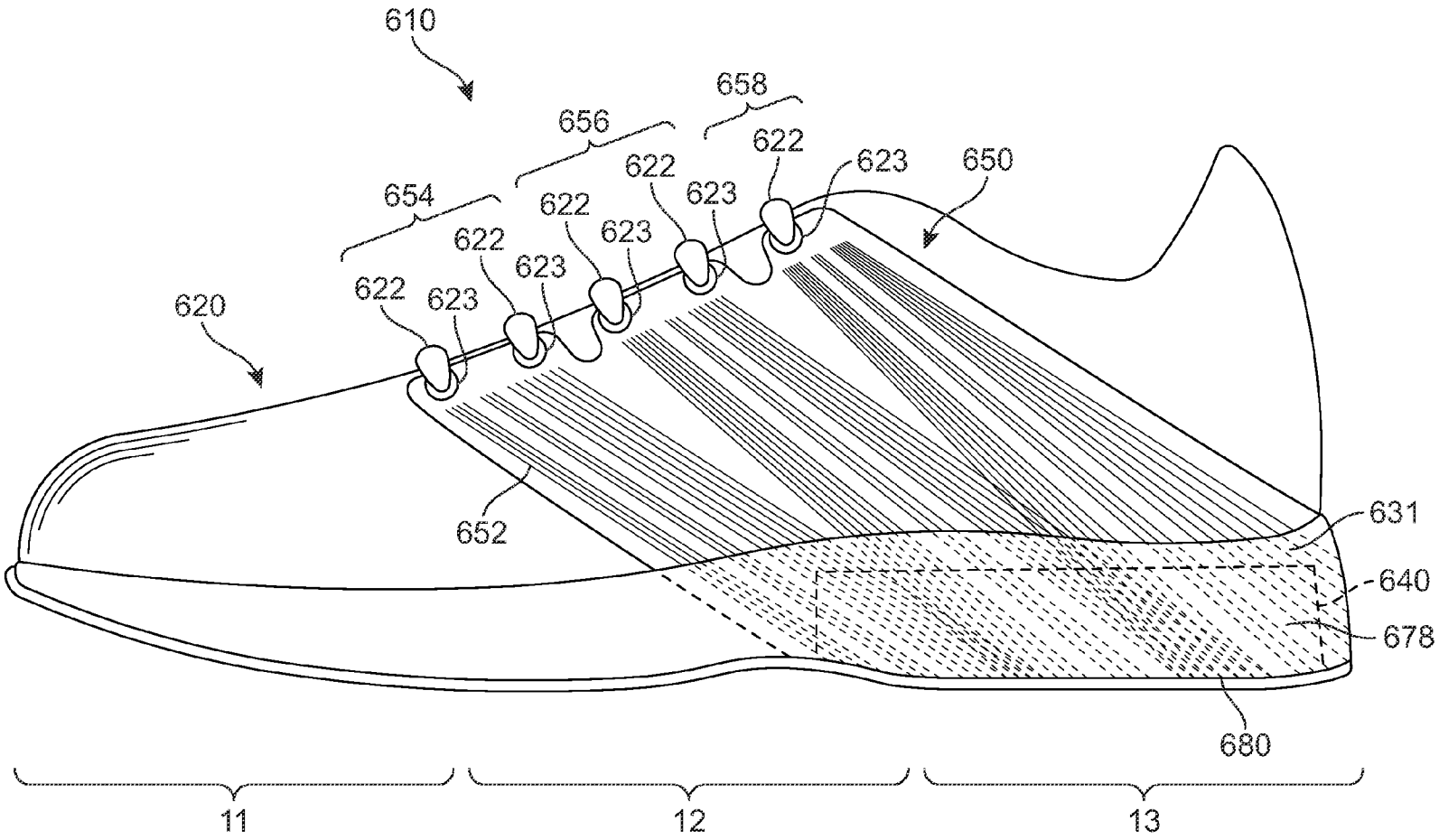

FIG. 5 is a cross-sectional view of a portion of the heel region of FIGS. 3 and 4 taken along line 5-5 of FIGS. 3 and 4;

FIG. 6 is a cross-sectional view of a heel region for another exemplary configuration of an article of footwear having a structural harness in an arrangement with a fluid-filled chamber;

FIG. 7 is a cross-sectional view of a heel region for yet another exemplary configuration of an article of footwear having a pair of tubular fluid-filled chamber portions peripherally disposed at side regions of the outsole in an arrangement with a structural harness extending around bottom regions of the tubular chamber portions;

FIG. 8 is a cross-sectional view of a heel region for an additional exemplary configuration of an article of footwear having a pair of tubular fluid-filled chamber portions disposed at side regions of the outsole in an arrangement with a structural harness attached to outer side portions of the tubular chamber portions;

FIG. 9 is a cross-sectional view of a heel region for another exemplary configuration of an article of footwear having a split configuration of a structural harness in an arrangement with a fluid-filled chamber;

FIG. 10 is a cross-sectional view of a heel region for another exemplary configuration of an article of footwear having a structural harness in an arrangement with a fluid-filled chamber and bonded to an upper portion of the fluid-filled chamber; and FIG. 11 is a lateral side view of the article of footwear of FIG. 1, showing another exemplary configuration wherein a portion of the harness is disposed proximate the lace eyelets, and groups of the plurality of structural threads of the harness are structurally connected to the lace eyelets and extend downward toward the gas-filled chamber.

DETAILED DESCRIPTION

The following discussion and accompanying figures disclose various configurations of structural harnesses in cooperative arrangements with fluid-filled chambers of articles of footwear that may provide various advantageous features. Concepts related to the structural harnesses and fluid-filled chambers are disclosed with reference to footwear having configurations that are suitable for common uses including walking, running, and general athletic activities.

Features pertaining to arrangements of structural harnesses and fluid-filled chamber features discussed herein are not limited to the example types of footwear shown, but rather may be utilized with a wide range of athletic and nonathletic footwear styles, including basketball shoes, tennis shoes, football shoes, cross-training shoes, walking shoes, and soccer shoes, for example. Features related to these arrangements may also be utilized with footwear styles that are generally considered to be nonathletic, including dress shoes, loafers, sandals, and boots. The concepts disclosed herein may, therefore, apply to a wide variety of footwear styles, in addition to the specific styles and types discussed in the following material by way of example and depicted in the accompanying figures.

An article of footwear 10 is depicted in FIGS. 1-5 as including an upper 20, a sole structure 30, a fluid-filled chamber 40 and a structural harness 50. For reference purposes, footwear 10 may be divided into three general regions: a forefoot region 11, a midfoot region 12, and a heel region 13, as shown in FIGS. 3 and 4. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual components thereof.

Upper 20 is depicted as having a substantially conventional configuration incorporating a plurality of material elements (e.g., textiles, foam, leather, and synthetic leather) that are stitched, adhesively bonded or otherwise attached together to form an interior void for receiving a foot securely and comfortably. The material elements may be selected and located with respect to upper 20 in order to impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, such as lace eyelets 23, and a tongue portion of upper 20 may extend between the interior void and lace 22. Given that various aspects of the present disclosure primarily relate to sole structure 30, upper 20 may exhibit the general configuration discussed above or the general configuration of practically any other conventional or nonconventional upper. Accordingly, the structure of upper 20 may vary significantly within the scope of the present disclosure.

Sole structure 30 may be secured to upper 20 and may have a configuration that extends between upper 20 and the ground. The primary elements of sole structure 30 are a midsole 31 and an outsole 32. Midsole 31 may be formed from a polymer foam material, such as polyurethane or ethylvinylacetate, which may encapsulate a fluid-filled chamber 40 to enhance the ground reaction force attenuation characteristics of sole structure 30. In addition to the polymer foam material of midsole 31 and fluid-filled chamber 40, midsole 31 may incorporate one or more plates, moderators, or reinforcing structures, for example, that may further enhance the ground reaction force attenuation characteristics of sole structure 30 or the performance properties of footwear 10. Outsole 32, which may be absent in some configurations of footwear 10, may be secured to a lower region of midsole 31 and may be formed from a rubber material that provides a durable and wear-resistant surface for engaging the ground. Outsole 32 may also be textured to enhance the traction (i.e., friction) properties between footwear 10 and the ground. In addition, sole structure 30 may incorporate a sockliner 35 that is located within the void in upper 20 and adjacent a plantar (i.e., lower) surface of the foot to enhance the comfort of footwear 10.

Fluid-filled chamber 40, as shown in FIGS. 1-5, may be integrated within sole structure 30 and may be disposed at heel region 11 to impart shock absorption and impact attenuation features to the user's heel during use. However, it is understood that fluid-filled chamber 40 may be disposed at other regions and may extend into other regions, and that multiple fluid-filled chambers may be used with article of footwear 10 in various configurations. Fluid-filled chamber 40 may be formed from an elastomeric polymer material or other material having desired properties such as elasticity and fluid retention properties. Fluid-filled chamber 40 is sealed after being filled with a fluid, such as air, to approximately atmospheric pressure or pressurized to a pressure greater than atmospheric pressure as desired, but may also be substantially unpressurized. Approximately atmospheric pressure, as described herein, for example, may be about zero psi to about 5 psi gauge pressure.

Fluid-filled chamber 40 may be compressible and expandable as desired for the footwear application and may be manufactured by various techniques, such as a two-film technique in which two separate sheets of elastomeric film are bonded together to form a peripheral bond on the exterior of the chamber and to form a generally sealed structure. The sheets may also be bonded together at predetermined interior areas to give the chamber a desired configuration. That is, interior bonds (i.e., bonds spaced inward from the peripheral bond) may provide the chamber with a predetermined shape and size upon pressurization and/or control its configuration during use. In order to pressurize the chamber, a nozzle or needle may be connected to a fluid pressure source and inserted into a fill inlet formed in the chamber. Following pressurization of the chamber, the fill inlet may be sealed and the nozzle removed. A similar procedure, such as thermoforming, may also be utilized, in which a heated mold forms or otherwise shapes the sheets of elastomeric film during the manufacturing process.

Chambers may also be manufactured by a blow-molding technique, wherein a molten or otherwise softened elastomeric material in the shape of a tube is placed in a mold having the desired overall shape and configuration of the chamber. The mold has an opening at one location through which pressurized air is provided. The pressurized air induces the liquefied elastomeric material to conform to the shape of the inner surfaces of the mold. The elastomeric material then cools, thereby forming a chamber with the desired shape and configuration. As with the two-film technique, a nozzle or needle connected to a fluid pressure source may be inserted into a fill inlet formed in the chamber in order to pressurize the chamber. Following pressurization of the chamber, the fill inlet may be sealed and the nozzle removed.

Structural harness 50 generally provides a robust structural interface between components in tension in desired directions, but which may otherwise have little impact between components in other directions. For example, in the configuration shown in FIGS. 1-5, structural harness 50 attaches to fluid-filled chamber 40 and portions of upper 20 and provides robust structural support for transmitting tensile forces between the chamber and the upper. Such an interface may bias fluid-filled chamber 40 upward away from outsole 32 and toward upper 20 to stabilize the fluid-filled chamber in a desired position and provide various advantages. For example, such an interface may prestress or pre-compress the fluid-filled chamber as appropriate for a particular type of article of footwear or limit expansion or movement of the chamber in a direction away from the upper. However, structural harness 50 may have little effect otherwise between components, such as having little effect on movement of the chamber in an opposite direction toward the upper. Such features of the harness may be provided via its relatively thin and flexible textile configuration that also includes tensile expansion-limiting features via its structural threads.

Figure 2:
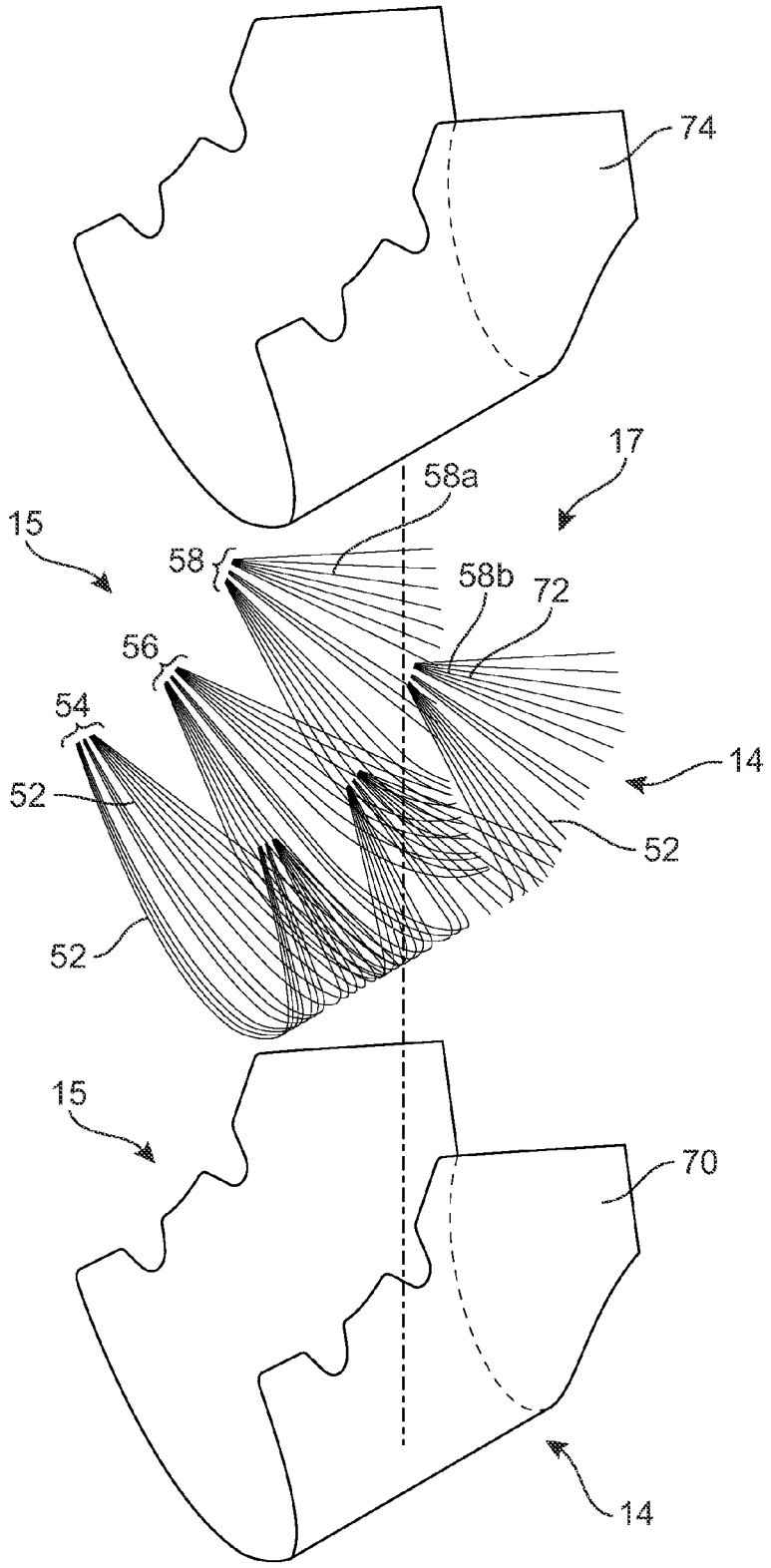
FIG. 2 is an exploded perspective view of an exemplary harness configuration that may be used with the article of footwear of FIG. 1, showing structural threads of the harness and other layers that may be included in the harness.

As shown in FIG. 2, harness 50 may be formed from multiple material layers that each imparts different properties to various areas of the harness in various directions. The multiple layers may include a base layer 70 and a thread layer 72 and, in some exemplary configurations, an upper layer 74. In exemplary configurations having both a base layer and upper layer, the base layer 70 and upper layer 74 may bond with the thread layer 72 on opposite sides such that the thread layer 72 is sandwiched between them. During use, the harness may experience significant tensile forces, which the one or more layers of material may be configured to resist. That is, individual layers may be configured in specific portions of the harness to resist tensile forces in particular directions that arise during use of the footwear and/or that may provide advantageous features to the article of footwear.

As an example, a woven textile may be incorporated into the harness as the base layer or upper layer to impart stretch resistance in a longitudinal direction. A woven textile may be formed from yarns that interweave at right angles to each other. If the woven textile is incorporated into the article of footwear for purposes of longitudinal stretch-resistance, then only the yarns oriented in the longitudinal direction will contribute to longitudinal stretch-resistance, and the yarns oriented orthogonal to the longitudinal direction will not generally contribute to longitudinal stretch-resistance. Accordingly, a woven textile used with harness 50 may have concentrations of yarns in orientations and configurations as appropriate for providing longitudinal stretch-resistance in desired directions while having fewer yarns in other orientations and configurations within the textile that will not be subjected to as many stresses. Thus, woven textiles used with structural harness 50 may be woven to provide directional structural properties as appropriate for the harness. Further, select portions of the woven textiles may be reinforced to provide appropriate features for an article of footwear, such as wear resistance to high stress regions of the article.

In addition, structural longitudinal elements, such as structural threads 52 may be incorporated in structural harness 50 and arranged as appropriate to provide even greater structural properties like longitudinal stretch resistance in desired directions. Threads 52 may include various "one-dimensional materials," elongate materials or variants thereof as described in U.S. Pat. No. 7,574,818 and U.S. Pat. No. 7,546,698 to James Meschter, both of which are incorporated herein by reference in their entirety. Other aspects, preferences, features and configurations pertaining to structural harnesses may be found in these references and in U.S.

patent Publication Ser. No. 12/424,804 to Shawn G. Carboy et al., which is also incorporated herein by reference in its entirety.

Each of threads 52 may be oriented and arranged in harness 50 to provide structural elements in the harness in desired directions. The threads are configured to resist stretching along their longitudinal axes and, accordingly, may transmit forces longitudinally when placed in tension. As discussed further in the references noted above and incorporated herein by reference, threads 52 may be formed, for example, from various filaments and yarns that may provide appropriate stretch-resisting properties. For instance, the thread filaments may be formed from a plurality of synthetic materials such as rayon, nylon, and polyester. In addition, various engineering fibers may be used to form thread filaments, such as aramid fibers, para-aramid fibers, and carbon fibers.

Base layer 70 may be formed from various two-dimensional materials, such as various textiles, polymer sheets, or combinations of textiles and polymer sheets. Threads 52 may be attached to base layer 70 through various mechanisms and arrangements as desired and appropriate for particular configurations. For instance, threads 52 may be mechanically integrated into base layer 70, such as by being embroidered into the two-dimensional material or by being stitched to the base layer via other threads. In addition, threads 52 may be attached to base layer 70 via other mechanisms, such as by an adhesive bond or thermoplastic bond with the base layer provided by an adhesive or a thermoplastic material placed over the threads that are heated to bond with the base layer and the threads.

In some exemplary configurations, harness 50 may be substantially formed via base layer 70 and thread layer 72 without including upper layer 74, which may add bulk to the harness at a face that may be unexposed when assembled on the article of footwear. In other exemplary configurations, upper layer 74 may be a relatively thin layer of bonding material that may bond the threads to the base layer, as well as bond the harness to the upper and the fluid-filled chamber. For example, upper layer 74 may be an adhesive sheet or heat-meltable thermoplastic sheet that may bond threads to the base layer and/or the harness to the upper and fluid-filled chamber. In yet other exemplary configurations, upper layer 74 may be formed from substantially the same material as base layer 70. The opposing layers may sandwich the thread layer therebetween and form a protected covering for the structural threads.

Threads 52 may be arranged in groups that may cooperate to provide structural features at the locations and in the orientations where forces are concentrated in order to provide desired features, such as the exemplary configuration of groups 54, 56, and 58 as shown in FIG. 2. In the exemplary configuration shown, a pair of thread groups 54 and 56 is provided that each includes a plurality of continuous threads 52 extending between a lateral side 14 and a medial side 15 of harness 50. Harness 50 may further include a third group 58 that includes a plurality of threads 58*a* extending from medial side 15 of the harness toward the lateral side, and a plurality of threads 58*b* extending from lateral side 14 toward the medial side, both of which may turn rearward toward a heel portion 17 as they extend inward on the harness.

When installed in article of footwear 10, the threads of third group 58 may extend downward and rearward from lateral side region 14 and medial side region 15 to lower rearward portions of the heel region for securely attaching the harness to the article of footwear and providing support for the continuous threads of groups 54 and 56 placed in a tensile arrangement around fluid-filled chamber 40. Groups 54 and 56 may extend from opposite side regions of upper 20 and wrap around lower regions of fluid-filled chamber 40 to provide advantageous features. More particularly, thread groups 54 and 56 in harness 50 may extend downward from a lateral side region 14 of the upper (as shown in FIG. 3, for example) and wrap around the fluid-filled chamber 40 by extending about its lateral side region 78, bottom region 80, and medial side region 82, and extend upward to a medial side region 15 of the upper (as shown in FIGS. 4 and 5, for example).

Harness 50 may be bonded to upper 20 and fluid-filled chamber 40 in various ways as desired and as beneficial for its structural requirements. For instance, harness 50 may be bonded to upper 20 along portions of its contact area with the upper in various ways including via adhesive or thermoplastic bonds and via embroidered or stitched connections. Further, harness 50 may be bonded to upper 20 along substantially its entire contact area with the upper (not shown) or at various locations as desired and beneficial for the particular structural arrangement. In addition, harness 50 may extend upward toward the lace region to be co-extensive with one or more of the lace eyelets 23 (as described later, for example, with reference to FIG. 11).

As shown in FIG. 5, harness 50 may be secured to upper 20 and fluid-filled chamber 40 in a tensile arrangement in which harness 50 transmits forces to the chamber to bias it in an upward direction away from outsole 32 and toward upper 20. In particular, structural threads 52 in the harness extending from side regions 14 and 15 of the upper to the fluid-filled chamber may be placed under tension and, thus, transmit upward biasing forces to the chamber. The fluid-filled chamber may be bounded at its upper region by an inner surface 84 of a top region of sole structure 30, which limits its ability to move upward. Accordingly, fluid-filled chamber 40 may be compressed by harness 50 transmitting forces to bias it upward, which increases its internal pressure and more securely retains it within sole structure 30.

In the arrangement of FIG. 5, in which harness 50 wraps around side regions and the bottom region of fluid-filled chamber 40, harness 50 may be attached to fluid-filled chamber via a mechanical geometric attachment mechanism formed by the harness enveloping the fluid-filled chamber 40 on three sides and biasing it against inner surface 84 of the sole structure. Such a configuration may provide advantages by allowing fluid-filled chamber 40 and portions of harness 50 that contact the chamber to translate with respect to each other during use and when the article of footwear is encountering various forces and attenuating impacts it receives. Allowing contact portions of the harness and fluid-filled chamber the freedom to translate with respect to each other may reduce wear and tear on the interface between them, which may occur at bonded connections between such components, where stress concentrations often form as the components encounter dynamic stresses. Permitting the interfaces between these components the freedom to translate may also improve the transfer of forces between them as they adjust to varying impacts and stress conditions during use of the footwear.

In other exemplary configurations, such as configurations encountering fewer stresses or in which stress concentrations between the components may be less significant, portions of harness 50 disposed proximate fluid-filled chamber 40 may be bonded to the chamber. Bonded connections between the harness and fluid-filled chamber may more securely retain the chamber and harness in a desired orientation and relationship. For example, harness 50 may be bonded to fluid-filled chamber 40 along its lateral side region (e.g., lateral side wall) 78 and its medial side region (e.g., medial side region) 82. In another example, harness 50 may be bonded to fluid-filled chamber 40 along its bottom region (e.g., bottom wall) 80. This may be done either with or without bonds being formed along its side regions, where the likelihood of stress concentrations may be greater and where it may be beneficial to allow the harness and chamber free to translate at their interface. In some configurations, the bonds may be formed via chemical bonds, such as thermoplastic melt bonds and adhesive bonds.

Referring to FIG. 6, another exemplary configuration of an article of footwear 110 is shown, which generally includes the aspects, features and preferences of article of footwear 10 except as discussed hereafter. As shown, fluid-filled chamber 140 may include a tensile member 190 disposed inside of the chamber. Although tensile member 190 is shown in this configuration as a "stacked" tensile member, the tensile member may be formed as another type of expansion-limiting member disposed inside of the fluid-filled chamber, such as a "single" tensile member generally formed by a single layer spacer textile. Interior tensile members, such as tensile member 190, generally limit the expansion of chamber 140 and retain an intended shape of barrier portions of the chamber interfacing with interior portions of sole structure 30.

Harness 150 may be disposed about fluid-filled chamber 140 as described above with reference to FIG. 5 and harness 50, except that structural threads 52 within harness 150 may be configured to transmit tensile forces from upper 20 to fluid-filled chamber 140 while in the natural state that are about the same or less than the tensile forces provided by interior tensile member 190. Accordingly, harness 150 may cooperate with tensile member 190 to provide advantages like improved shock absorption and impact attenuation via a more robust fluid-filled chamber configuration by providing external forces to the fluid-filled chamber that reinforce the actions of tensile member 190. Further, harness 150 may act to reinforce retention of fluid-filled chamber 140 in its desired position within sole structure 30, while biasing the entire chamber upward away from outsole 32 and toward upper 20, which benefits are not provided by interior tensile member.

Referring to FIG. 7, another exemplary configuration of an article of footwear 210 is shown, which generally includes the aspects, features and preferences of article of footwear 10 except as discussed hereafter. As shown, fluid-filled chamber 240 may be configured to include a pair of elongate fluid-filled chamber portions 240*a* and 240*b* disposed peripherally along the lateral and medial side portions of sole structure 230. The peripheral fluid-filled chamber portions may each be a portion of a separate fluid-filled chamber. In another configuration, the peripheral fluid-filled chamber portions 240*a* and 240*b* may be different portions of the same fluid-filled chamber, such as an elongate fluid-filled chamber that is generally U-shaped and extends from a lateral side region of sole structure 230 around a heel region to a medial side region of the sole structure.

Still referring to FIG. 7, midsole 231 may include a reinforcing structure 233 disposed between fluid-filled chamber portions 240*a* and 240*b* to support the fluid-filled chamber portions and maintain them in a desired position and orientation. Gap 235 may be formed between a lower region of midsole reinforcing structure 233, inner side regions of fluid-filled chamber portions 240*a* and 240*b*, and a bottom region 255 of harness 250. Gap 235 may permit compression of fluid-filled chamber portions 240*a* and 240*b* during use, such as while attenuating an impact. In addition, midsole reinforcing structure 233 may provide a compression stop for situations when gap 235 is substantially closed due to high compression. In such a situation, reinforcing structure 233 may act as a stop when a pre-determined compression limit is met such that bottom region 255 of the harness and outsole 232 have moved upward in response to an impact and into a contact position with reinforcing structure 233.

Still referring to FIG. 7, harness 250 may be generally disposed about fluid-filled chamber 240 in the same manner as described above for FIG. 5 and harness 50, except that a bottom region 255 of harness 250 spans across gap 235 formed between the fluid-filled chamber portions. Accordingly, harness 250 may assist with providing stability to fluid-filled portions 240*a* and 240*b* and maintaining them in their desired position during use, as well as limiting expansion of the fluid-filled portions to maintain them in a partially compressed state in the natural state.

Referring to FIG. 8, another exemplary configuration of an article of footwear 310 is shown, which generally includes the aspects, features and preferences of article of footwear 210 shown in FIG. 7 except as discussed hereafter. As shown, instead of extending across gap 235 and wrapping around bottom regions of fluid-filled chambers 240*a* and 240*b* as shown in FIG. 7, harness 350 shown in FIG. 8 may extend downward from each of the upper side regions to the side regions of the fluid-filled chamber without extending beyond the side regions. In particular, a lateral side region 350*a* of harness 350 may extend downward from lateral side region 314 of upper 20 to a lateral side region 347 of fluid-filled chamber portion 240*a* where it may be bonded to fluid-filled chamber portion 240*a*. The harness may be bonded to fluid-filled chamber portion 240*a* at its lateral side region 347 via various techniques and mechanisms as discussed above for harness 50, such as via adhesive and melt-bonding techniques. Similarly, medial side region 350*b* of harness 350 on the opposite of the article of footwear may extend downward from medial side region 315 of upper 20 to a medial side region 349 of fluid-filled chamber portion 240*b* where it may also be bonded to its respective fluid-filled chamber portion 240*b*.

The exemplary configuration of FIG. 8 may provide similar advantages and features as the configuration of FIG. 7, such as enhancing stability and compression control and limiting expansion of fluid-filled chamber 240. The configuration of FIG. 8, however, may provide these advantages and features with less bulk by eliminating a bottom portion of the harness extending below the fluid-filled chamber. For example, if a desired amount of pre-compression and expansion-limiting features for the fluid-filled chamber is substantially less than a desired amount for the configuration of FIG. 7, and maintaining the position of fluid-filled chamber 340 is less of a concern, potential benefits might be gained from wrapping the harness around the bottom region of the fluid-filled chamber may be negligible, if any. Accordingly, the exemplary configuration of FIG. 8 may provide benefits similar to those discussed with reference to FIG. 7, but with less bulk and complexity via elimination of the bottom region of the harness.

Referring to FIG. 9, another exemplary configuration of an article of footwear 410 is shown, which generally includes the aspects, features and preferences of article of footwear 10 discussed above along with FIGS. 1-5 except as discussed hereafter. As shown, harness 450 includes a pair of opposing lateral harness structures 451, 452 disposed on opposite lateral regions of upper 420. Opposing lateral harness structures 451, 452 may extend downward from each of the upper side regions to the side regions of fluid-filled chamber 440 and further extend beyond the side regions to cover only portions of the bottom of fluid-filled chamber 440 above a bottom portion of outsole 432 and inside outsole side portions 434. In particular, lateral side regions 451, 452 of harness 450 may extend downward from upper 420, where they may be bonded to fluid-filled chamber 440 at harness regions 453, 454, respectively. Lateral side regions 451, 452 of harness 450 may further extend downward from harness regions 453, 454, respectively, where they may be bonded to bottom portions of fluid-filled chamber 440 at harness regions 455, 456, respectively. Harness 450 may thus be bonded to fluid-filled chamber 440 via various techniques and mechanisms as discussed above for harness 50, such as via adhesive and melt-bonding techniques.

The exemplary configuration of FIG. 9 may also provide similar advantages and features as the configurations of FIGS. 7 and 8, such as enhancing stability and compression control and limiting expansion of fluid-filled chamber 440. The configuration of FIG. 9, however, may provide these advantages and features with less bulk by eliminating complete coverage and bonding of harness 450 along the bottom portion of fluid-filled chamber 440, but with greater strength and possibly less likelihood of delamination of harness 450. For example, if a desired amount of pre-compression and expansion-limiting features for the fluid-filled chamber is substantially less than a desired amount for the configuration of FIG. 7 or 8, and maintaining the position of fluid-filled chamber 440 is less of a concern, while still retaining the strength benefits afforded by harness 450, potential benefits might be gained from wrapping the harness around only a portion of the bottom region of the fluid-filled chamber. Accordingly, the exemplary configuration of FIG. 9 may provide benefits similar to those discussed with reference to FIGS. 7 and 8, but with less bulk and complexity while retaining a least a portion of the strength benefits afforded by harness 450.

Referring to FIG. 10, another exemplary configuration of an article of footwear 510 is shown, which generally includes the aspects, features and preferences of article of footwear 10 discussed above along with FIGS. 1-5 except as discussed hereafter. As shown, harness 550 includes a pair of opposing lateral harness structures 551, 552 disposed on opposite lateral regions of upper 520. Opposing lateral harness structures 551, 552 may extend downward from each of the upper side regions and underneath upper 520 and across an upper surface of fluid-filled chamber 540. In particular, harness 550 may extend downward from upper 520, where it may be bonded to an upper surface of fluid-filled chamber 540 at harness region 553. Harness 550 may thus be bonded to fluid-filled chamber 540 via various techniques and mechanisms as discussed above for harness 50, such as via adhesive and melt-bonding techniques.

The exemplary configuration of FIG. 10 may also provide similar advantages and features as the configurations of FIGS. 7-9, such as enhancing stability and compression control and limiting expansion of fluid-filled chamber 540. The configuration of FIG. 10, however, may provide advantages and features by enhancing structural support around upper 520 while still maintaining a bonding interface with fluid-filled chamber 540. For example, if there is greater concern for structural support in upper 520 and less concern for pre-compression and expansion-limiting features for fluid-filled chamber 540, and maintaining the position of the fluid-filled chamber 540 is less of a concern, while still retaining the strength benefits afforded by harness 550, potential benefits might be gained from wrapping the harness around only upper 520 and across an upper surface of fluid-filled chamber 540, e.g., at harness region 553. Accordingly, the exemplary configuration of FIG. 10 may provide benefits similar to those discussed with reference to FIGS. 7-9.

Referring to FIG. 11, another exemplary configuration may be achieved. Similar to the exemplary configurations described earlier with reference to FIGS. 2 and 3, threads 652 may be arranged in groups that may cooperate to provide structural features at the locations and in the orientations where forces are concentrated in order to provide desired features, such as the exemplary configuration of thread groups 654, 656, and 658 as shown in FIG. 11. In the exemplary configuration shown, a pair of thread groups 654 and 656 is provided that each includes a plurality of continuous threads 652 extending between a lateral side 14 (shown) and a medial side 15 (not shown) of harness 650. Harness 650 may further include a third group of threads 658 extending from lateral side 14 (shown) of the harness 650 toward the medial side (not shown), which may turn rearward toward a heel portion 17 as they extend inward on harness 650. While three groups of threads are shown with respect to this embodiment, more or less groups of threads may be implemented consistent with this embodiment to achieve the disclosed advantages.

When installed in article of footwear 610, the threads of third group 658 may extend downward and rearward from lateral side 14 (shown) and a medial side 15 (not shown) of harness 650 to lower rearward portions of the heel region for securely attaching the harness to the article of footwear and providing support for the continuous threads of groups 654 and 656 placed in a tensile arrangement around fluid-filled chamber 640. Further, groups 654 and 656 may extend from opposite side regions of upper 620 and wrap around lower regions of fluid-filled chamber 640 to provide advantageous features. More particularly, thread groups 654 and 656 in harness 650 may extend downward from a lateral side region 14 of the upper (as shown in FIG. 3, for example) and wrap around the fluid-filled chamber 640 by extending about its lateral side region 678, bottom region 680, and lateral side region (shown), and extend upward to a medial side region of upper 620 (as shown in FIGS. 4 and 5, for example).

Harness 650 may be bonded to upper 620 and fluid-filled chamber 640 in various ways as desired and as beneficial for its structural requirements. For instance, harness 650 may be bonded to upper 620 along portions of its contact area with the upper in various ways including via adhesive or thermoplastic bonds and via embroidered or stitched connections. Further, harness 650 may be bonded to upper 620 along substantially its entire contact area with the upper (not shown) or at various locations as desired and beneficial for the particular structural arrangement. In addition, harness 650 may extend upward toward the lace region to be co-extensive with one or more of the lace eyelets 623. In such an exemplary configuration, end portions of thread groups, such as groups 654 and 656, may extend around one or more of the lace eyelets 623. Such an arrangement may permit the lace 622 and the lacing system to enhance stability of the harness attachment and reinforce its arrangement around the fluid-filled chamber 640 and upper 620, and to exert compressive forces on the chamber.

While various embodiments have been described, the description is intended to be exemplary, rather than limiting, and it will be apparent to those of ordinary skill in the art that many more embodiments and implementations are possible that are within the scope of the disclosure. It is intended that all such additional systems, methods, features and advantages be included within this description and this summary, be within the scope of the disclosure, and be protected by the following claims.

The invention claimed is:

1. An article of footwear, comprising:

an upper having a medial side surface and a lateral side surface;

a sole structure comprising a lateral side portion, an opposite medial side portion, a top portion proximate the upper, and an opposite bottom portion having a ground-contacting surface, the sole structure being secured to the upper and including an outsole, an impact-attenuating structure comprising at least one fluid-filled chamber, and a midsole disposed between the at least one fluid-filled chamber and the upper;

and a structural harness extending between the upper and the impact-attenuating structure in a tensile arrangement, the structural harness extending continuously from a first end disposed on the medial side surface of the upper, along and directly contacting the at least one fluid-filled chamber in an area between the outsole and the at least one fluid-filled chamber, to a second end disposed on the lateral side surface of the upper to bias the at least one fluid-filled chamber toward the midsole, wherein the at least one fluid-filled chamber includes a lateral side wall and a medial side wall, the structural harness extending along and directly contacting the lateral side wall of the at least one fluid-filled chamber and the medial side wall of the at least one fluid-filled chamber, and wherein the midsole includes a lateral side and a medial side, the structural harness extending between the midsole and the outsole and along and directly contacting the lateral side of the midsole and the medial side of the midsole;

wherein the structural harness comprises: a first base layer; and a thread layer bonded to the first base layer, the thread layer including a plurality of threads, each of the plurality of threads transmitting tensile forces and restricting stretch in a longitudinal direction of the thread, the structural harness further comprising a second base layer bonded to the thread layer on an opposite side of the thread layer from the first base layer.

2. The article of footwear of claim 1, wherein the structural harness imparts compressive forces on the impact-attenuating structure while biasing the impact-attenuating structure toward the upper.

3. The article of footwear of claim 1, wherein the impact-attenuating structure further comprises a foam polymer structure incorporated with the at least one fluid filled chamber, and the structural harness is attached to the at least one fluid filled chamber.

4. The article of footwear of claim 3, wherein the structural harness is attached to at least an upper portion of the at least one fluid filled chamber.

5. The article of footwear of claim 3, wherein the structural harness imparts compressive forces on the impact-attenuating structure while biasing the impact-attenuating structure toward the upper.

6. The article of footwear of claim 5, wherein the structural harness is attached to at least a lower portion of the at least one fluid filled chamber.

7. The article of footwear of claim 5, wherein the structural harness is attached to at least side portions of the at least one fluid filled chamber.

8. The article of footwear of claim 7, wherein the structural harness includes a pair of structural harness sections disposed on opposite lateral regions of the article of footwear and to opposite side portions of the at least one fluid filled chamber.

9. The article of footwear of claim 1, wherein portions of the plurality of threads are in a tensile configuration and apply compressive forces to the impact-attenuating structure.

10. The article of footwear of claim 9, wherein the portions of the plurality of threads further apply compressive forces to the fluid-filled chamber, and the fluid-filled chamber has an internal pressure greater than approximately atmospheric pressure while being compressed by the structural harness.

11. The article of footwear of claim 10, where the fluid-filled chamber is configured to have an internal pressure of about approximately atmospheric pressure in the absence of the tensile configuration of the plurality of threads.

12. The article of footwear of claim 1, wherein the at least one fluid-filled chamber includes a pair of elongate chamber regions peripherally disposed along the lateral and medial side portions of the sole structure, and the structural harness is bonded to outer side portions of the pair of elongate chamber regions.

13. The article of footwear of claim 1, where the structural harness is bonded to a bottom portion of the at least one fluid-filled chamber.

14. The article of footwear of claim 1, wherein the structural harness is bonded to a portion of the at least one fluid-filled chamber via a thermoplastic bond.

15. The article of footwear of claim 14, wherein the structural harness is bonded to a portion of the at least one fluid-filled chamber via an adhesive bond.

16. The article of footwear of claim 1, wherein the plurality of threads have a first end disposed at the medial side surface of the upper and a second end disposed at the lateral side surface of the upper, the plurality of threads comprising threads extending continuously between the medial side surface and the lateral side surface such that the threads each include a longitudinal axis extending between the medial side surface and the lateral side surface across a width of the at least one fluid-filled chamber.

17. An article of footwear, comprising:

an upper having a medial side surface and a lateral side surface;

a midsole having a first midsole surface opposing the upper and a second midsole surface formed on an opposite side of the midsole than the first midsole surface; and an expansion-limited gas spring, the expansion-limited gas spring comprising:

at least one gas-filled chamber having a first chamber surface opposing the second midsole surface and a second chamber surface formed on an opposite side of the gas-filled chamber than the first chamber surface, and an expansion-limiter disposed outside of the at least one gas-filled chamber and extending continuously from a first end disposed on the medial side surface of the upper, along and directly contacting the at least one gas-filled chamber at the second chamber surface, to a second end disposed on the lateral side surface of the upper, the expansion-limiter configured to mechanically limit expansion of the at least one gas-filled chamber in a downward direction away from the upper, wherein the at least one gas-filled chamber includes a lateral side wall and a medial side wall, the expansion-limiter extending along and directly contacting the lateral side wall of the at least one gas-filled chamber, the medial side wall of the at least one gas-filled chamber, and the second chamber surface of the at least one gas-filled chamber, and wherein the midsole includes a lateral side and a medial side, the expansion-limiter extending along and directly contacting the lateral side of the midsole and the medial side of the midsole;

wherein the expansion-limiter comprises a harness having a plurality of structural threads; and wherein the harness further comprises: a first base layer; a thread layer bonded to the first base layer, the thread layer including the plurality of structural threads; and a second base layer bonded to the thread layer on a side of the thread layer opposite the first base layer.

18. The article of footwear of claim 17, wherein portions of the plurality of structural threads are oriented to extend generally downward away from the upper.

19. The article of footwear of claim 18, wherein the plurality of structural threads substantially restrict stretch in a longitudinal direction to limit expansion of the gas-filled chamber in a downward direction away from the upper.

20. The article of footwear of claim 18, wherein the plurality of structural threads transmit tensile forces longitudinally to compress the gas-filled chamber upward toward the upper.

21. The article of footwear of claim 17, wherein the plurality of structural threads have a first end disposed at the medial side surface of the upper and a second end disposed at the lateral side surface of the upper, the plurality of structural threads comprising threads extending continuously between the medial side surface and the lateral side surface such that the threads each include a longitudinal axis extending between the medial side surface and the lateral side surface across a width of the at least one gas-filled chamber.

* * * * *